United States Patent [19]

Proud et al.

[11] 4,427,922

[45] Jan. 24, 1984

[54] ELECTRODELESS LIGHT SOURCE

[75] Inventors: Joseph M. Proud, Wellesley Hills; Stephen G. Johnson, Georgetown, both of Mass.

[73] Assignees: GTE Laboratories Inc., Waltham, Mass.; GTE Products Corp., Stamford, Conn.

[21] Appl. No.: 307,420

[22] Filed: Oct. 1, 1981

[51] Int. Cl.[3] ..... H05B 41/16; H05B 41/24

[52] U.S. Cl. ..... 315/248; 315/39; 313/638; 313/640

[58] Field of Search ..... 315/248, 39; 313/227, 313/229, 637, 638, 639, 640, 641, 642

[56] References Cited

U.S. PATENT DOCUMENTS

| | | | |
|---|---|---|---|
| 3,234,421 | 2/1966 | Reiling | 313/227 X |
| 3,319,119 | 5/1967 | Rendina | 315/248 |
| 3,521,111 | 7/1970 | Tsuchihashi et al. | 315/227 |
| 4,001,632 | 1/1977 | Haughsjaa et al. | 315/39 |

*Primary Examiner*—Saxfield Chatmon

*Attorney, Agent, or Firm*—David M. Keay

[57] ABSTRACT

A source of visible light including an electrodeless lamp containing a mercury halide. When the contents of the electrodeless lamp are excited by high frequency power, excited mercury (I) halide molecules emit visible light.

13 Claims, 5 Drawing Figures

ELECTRODELESS LIGHT SOURCE

BACKGROUND OF THE INVENTION

This invention relates to electromagnetic discharge apparatus. More particularly, it is concerned with electrodeless sources of visible light.

Electrodeless light sources which operate by coupling high frequency power to an arc discharge in an electrodeless lamp have been developed. These light sources typically include a high frequency power source connected to a coupling fixture having an inner conductor and an outer conductor disposed around the inner conductor. The electrodeless lamp is positioned adjacent to the end of the inner conductor. High frequency power is coupled to a light emitting electromagnetic discharge within the electrodeless lamp. A portion of the coupling fixture passes radiation at the frequencies of light produced, thus permitting the use of the apparatus as a light source.

SUMMARY OF THE INVENTION

It is an object of the present invention to provide an improved electromagnetic discharge apparatus.

It is another object of the invention to provide an electrodeless lamp which serves as a source of visible light.

An improved source of visible light is provided by electromagnetic discharge apparatus in accordance with the present invention. The apparatus comprises an electrodeless lamp having an envelope of a substance transparent to visible light. The fill material within the envelope comprises a mercury halide. Means are provided for coupling high frequency power to the fill material within the envelope. When high frequency power is applied, the fill material within the envelope is vaporized and excited producing visible light.

The mercury halide provides a source of mercury (I) halide molecules which are excited to a high energy state when high frequency is applied. The excited mercury (I) halide molecules emit visible light upon photon emission transition to a lower energy state. The characteristic feature of the spectrum of emitted light for each mercury (I) halide molecule is a pronounced continuum peaking in the visible portion of the spectrum with the peak shifting toward the violet with increasing molecular weight. In the case of mercury (I) chloride the visible continuum peaks in the green portion of the spectrum near 550 nm and a second band appears in the ultraviolet near 250 nm. Mercury (I) bromide emits light predominantly in the blue portion of the spectrum and mercury (I) iodide emits light predominantly in the violet portion of the spectrum. Mixtures of the mercury halides produce visible light in the portions of the spectrum as determined by each of the mercury halides present.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 3:
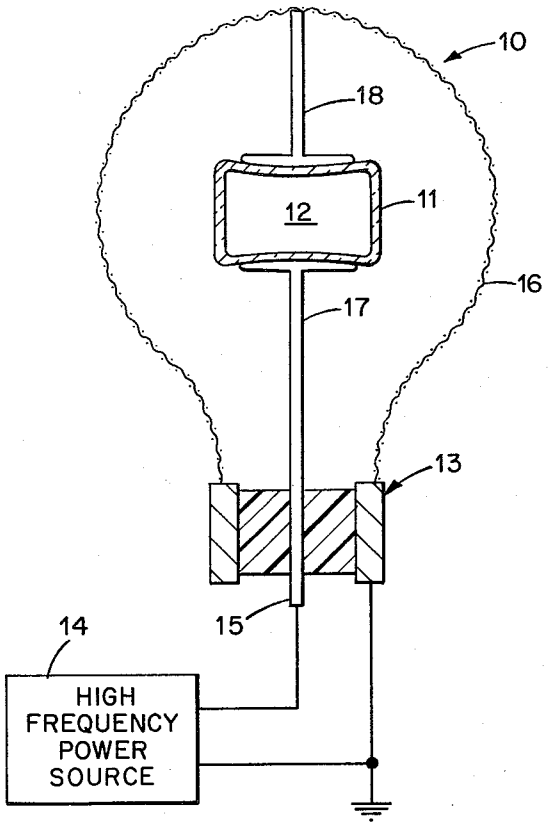
FIG. 3 is a schematic representation of an electrodeless radio frequency coupled discharge light source in accordance with one embodiment of the present invention.

One embodiment of an electromagnetic discharge apparatus in accordance with the present invention is illustrated in FIG. 3. The apparatus 10 includes an electrodeless lamp 11 containing a fill material 12. The electrodeless lamp 11 is supported within a coupling fixture 13 which couples power from a high frequency power source 14 to the fill material of the electrodeless lamp. The electrodeless lamp 11 forms a termination load for the fixture 13.

The electrodeless lamp 11 has a sealed envelope made of a suitable material which is transparent to visible light. The fill material 12 within the lamp envelope in accordance with the present invention includes a mercury halide. The vapor pressure of the mercury halide is preferably less than 50 torr. An inert buffer gas such as argon, xenon, or neon at a pressure of 1 to 50 torr, preferably less than 20 torr, is added to the mercury halide fill.

The coupling fixture 13 includes an inner conductor 15 and an outer conductor 16 disposed around the inner conductor. The outer conductor 16 includes a conductive mesh which acts as a conductor and provides shielding at the operating frequencies while permitting the passage of light radiated from the lamp 11. The lamp 11 is supported between a first metal electrode 17 at one end of the inner conductor 15 and a second metal electrode 18 connected to the outer conductor 16. The other ends of the inner and outer conductors are arranged in a coaxial configuration for coupling to the power source 14. In order to achieve electrodeless discharge it is necessary to employ RF power capable of penetrating the lamp envelope while being absorbed strongly in the low pressure discharge plasma contained therein. The power source 14 preferably is a source of continuous wave RF excitation in the range of from 902 to 928 MHz although frequencies from 1 MHz to 10 GHz may be used. Structural details of electromagnetic discharge apparatus as illustrated schematically herein are disclosed in application Ser. No. 307,418 filed concurrently herewith by Joseph M. Proud, Robert K. Smith, and Charles N. Fallier entitled "Electromagnetic Discharge Apparatus."

When high frequency power is applied to an electrodeless lamp 11 containing a mercury halide as described, a discharge is initiated in the buffer gas which warms the contents of the lamp causing an increase in the vapor pressure of the mercury halide. The fill is thus vaporized and excited, and the mercury (I) halide molecules formed in the discharge emit visible light.

Figure 1:
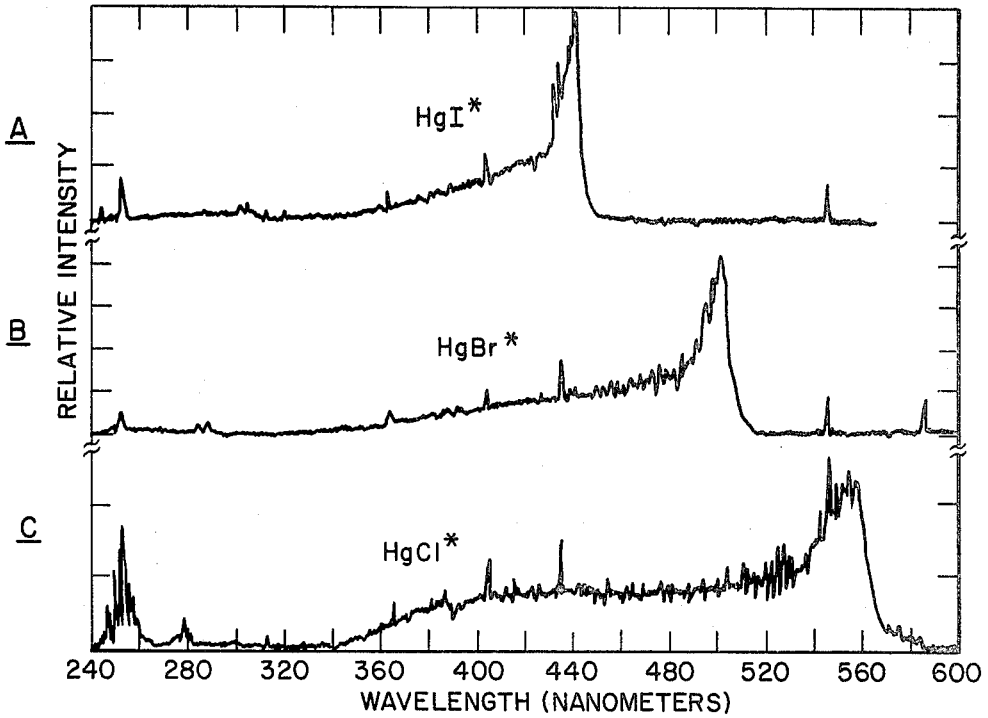
FIGS. 1A, B, and C illustrate the spectra emitted by discharges in mercuric iodide, mercuric bromide, and mercuric chloride, respectively.

The light observed from mercury (II) halide, $HgX_2$, discharges results from a photon emitting transition from one of several excited electronic states of the mercury (I) halide molecule, HgX, to the ground state of the molecule. Examples of the spectra from each of the mercury (I) halides, HgI, HgBr, and HgCl, are shown in FIGS. 1A, 1B, and 1C, respectively. The characteristic feature of the spectrum for each molecule is a pronounced continuum peaking in the visible region of the spectrum, the peak shifting toward the violet with increasing molecular weight. As illustrated by FIGS. 1A, 1B, and 1C, HgI, HgBr, and HCl emit visible light in the violet, blue, and green portions, respectively, of the spectrum. Although not illustrated in the figure, HgF emits visible light in the red portion of the spectrum. In certain cases, most particularly with HgCl, a substantial emission is present in the ultraviolet portion of the spectrum between about 200 and 260 nm. In a mixture of two or more of these materials each constituent produces its own spectrum with a relative intensity depending upon the amounts present.

Figure 2:
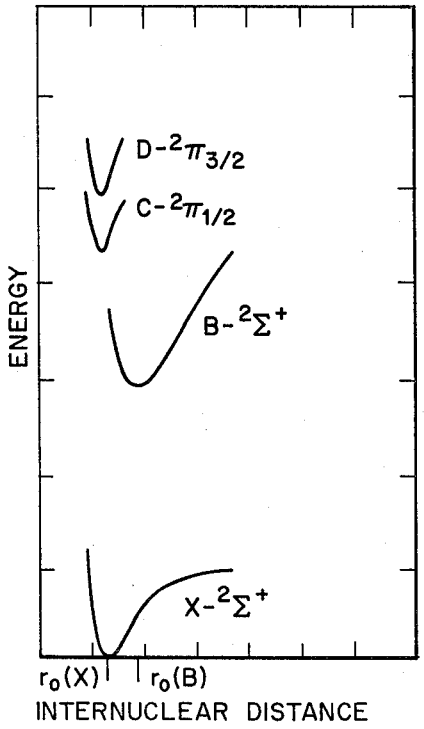
FIG. 2 is a diagram illustrating the potential energy level states of a typical mercury (I) halide molecule.
Figure 2A:
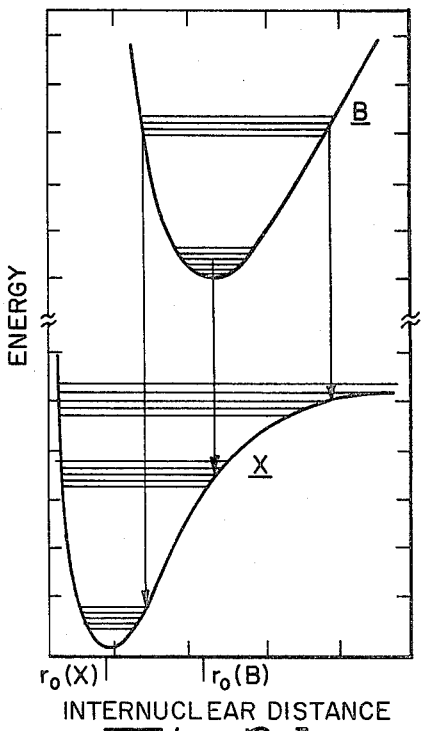
FIG. 2A is a detailed diagram showing that portion of FIG. 2 which illustrates transitions between vibrational levels in the B and X electronic states.

The mercury (I) halide emission spectra may best be understood by a discussion of the generalized potential surfaces of the electronic states associated with the molecule as shown in FIG. 2. All molecular emission observed in the visible part of the spectrum is attributed to transitions from the first excited electronic state, denoted the B state, to the ground state, denoted the X state, of the mercury (I) halide molecule. FIG. 2 illustrates that a common characteristic of the mercury (I) halides is that the X state is a broad, weakly bound covalent state and that the B state is a relatively strongly bound ionic state. The potential minimum for the X state, denoted $r_0$ (X), is always smaller than that of the B state, denoted $r_0$ (B), for the mercury (I) halides. Because of the relative positions of $r_0$ (B) to $r_0$ (X), transitions from low vibrational levels of the B state are to high vibrational levels of the X state, as shown more clearly in the detail of FIG. 2A. For transitions from the higher vibrational levels of the B state, the probability for emission is greatest near the walls of the potential surface. Hence the transitions from the right side of the potential surface of the B state terminate in very high vibrational levels, or even the dissociated state, of the X state molecule. Transitions from the left side of the potential surface result in a population of progressively lower vibrational levels of the X state molecule. Nearly all transitions observed in this molecular band system are to vibrational levels of the X state not normally populated in the molecule at the operating gas temperature.

Absorption of radiation is proportional to the number density of the species at the lower energy level of the transition. The number density of HgX molecules in the ground state is not sufficiently great that absorption of radiation followed by nonradiative collisional transitions result in a significant loss of efficiency. Furthermore, as stated hereinabove, most transitions are to excited vibrational levels which are rapidly quenched both collisionally and radiatively such that the number densities of these vibrationally excited ground state molecules should be small reducing the probability of reabsorption of molecular emissions. The efficiency of the source may also be enhanced because the lifetime of the B state is known to be very short reducing the probability that the excited molecule will encounter a quenching collision prior to radiating.

The potential surfaces of the excited electronic states C and D above the B state (FIG. 2) are structurally similar in the shape of their potential surfaces and in the location of their potential minimums to that of the ground state ($r_0$X). Consequently, transitions involving these states occur between vibrational levels of similar quantum number. Absorption may be a more significant problem for these states because of the dominance of lower vibrational level transitions. The emission spectra for these transitions occur in the ultraviolet region of the spectrum.

An illustrated in FIG. 1C discharges in $HgCl_2$ are characterized by a strong emission band in the ultraviolet portion of the spectrum near 250 nm. This emission is typical of pulsed discharges at temperatures between about 150° to 200° C. At lower temperatures, the atomic line spectrum of mercury becomes more pronounced producing the known resonance line emission at 254 nm. Also in the case of $HgCl_2$, an emission band appears near 200 nm which may be due to excitation of $HgCl_2$ molecules. With any of these sources of ultraviolet radiation available, it is possible to generate additional light and also to provide color correction by incorporating appropriate fluorescing material in the apparatus.

Figure 4:
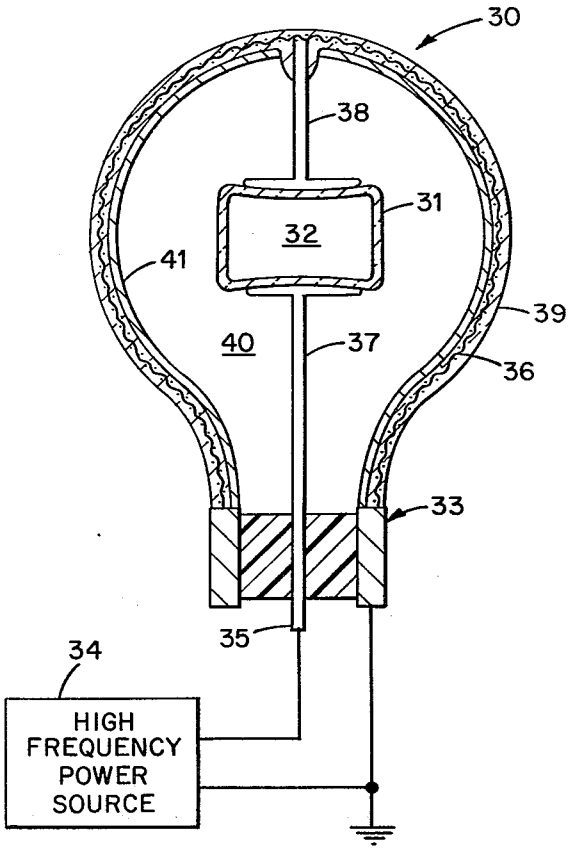
FIG. 4 is a representation of an alternative form of an electromagnetic discharge device in accordance with the present invention.

One form of such apparatus 30 is illustrated in FIG. 4. An electrodeless lamp 31 contains a fill 32 of a mercury (II) halide, preferably in accordance with this particular embodiment of mercuric chloride ($HgCl_2$) together with an inert buffer gas. An RF coupling fixture 33 includes a center conductor 35 and an outer mesh conductor 36 which may be laminated within an outer envelope 39 of a material that is transparent to visible light. In this embodiment the material of the electrodeless lamp 31 must be transparent to both visible light and ultraviolet radiation. The electrodeless lamp 31 is supported between conductive electrodes 37 and 38 connected to the inner conductor 35 and outer conductor 36, respectively. The ends of the conductors 35 and 36 terminate in a coaxial arrangement for connecting to a high frequency power source 34. A layer of a phosphor material 41 is adherent to the inner surface of the outer envelope 39. The space 40 between the inner and outer envelopes may be filled with an inert gas or a vacuum. It is particularly desirable that the phosphor material 41 be of the type which in response to receiving ultraviolet radiation emits visible light in the red portion of the spectrum. This fluorescent emission when added to the slightly green emission from the mercury (I) chloride molecule can provide a light output having improved color rendering capability. Since the phosphor material 41 is separated from the plasma discharge within the envelope 31 the phosphor material is not bombarded by plasma particles as in conventional fluorescent discharge lamps and therefore the material is protected from chemical and energetic particle attack and will not be degraded to the extent which is typical of conventional lamps.

Figure 5:
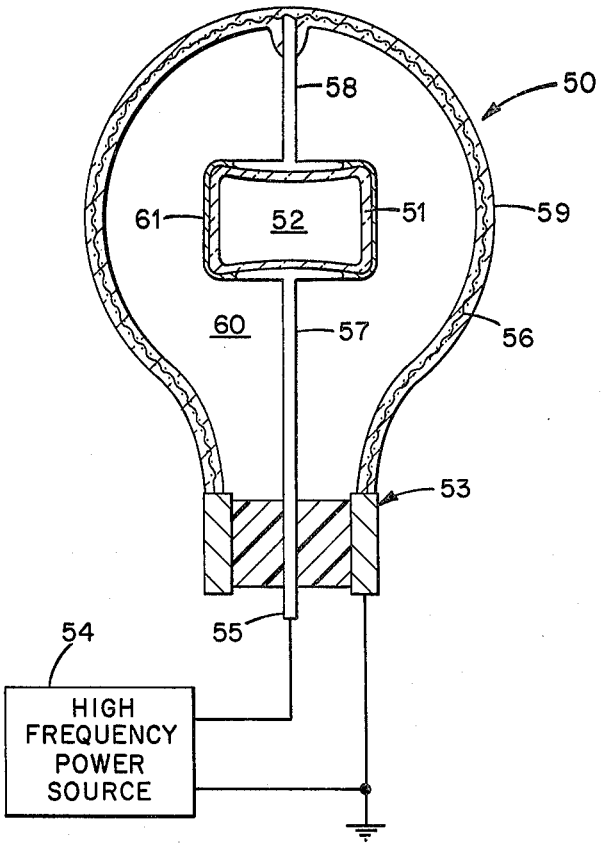
FIG. 5 is a representation of a modification of the device of FIG. 4.

FIG. 5 illustrates an apparatus 50 which is a modification of that of FIG. 4. The apparatus includes an electrodeless lamp 51 of a material which is transparent to both visible light and ultraviolet radiation and encloses a fill material 52 of $HgCl_2$ and an inert buffer gas. The electrodeless lamp 51 is mounted in a RF coupling fixture 53 having an inner conductor 55 and an outer mesh conductor 56 which is mounted within an outer envelope 59 of a material that is transparent to visible light. Metal electrodes 57 and 58 support the electrodeless lamp 51 and are connected to the inner and outer conductors 55 and 56, respectively. A high frequency power source 54 is connected to the ends of the conductors of the coupling fixture to supply high frequency power to the contents of the lamp 51. The space 60 between the inner and outer envelopes is a vacuum or contains an inert buffer gas. In this embodiment the fluorescing material is a solid phosphor material 61 which is adherent to the outer surface of the inner envelope 51. Although the use of phosphor materials is particularly useful to provide color correction for fills of $HgCl_2$, this feature may also be employed with other mercury halides uitlizing their lesser components of ultraviolet radiation.

Thus, there is provided an electromagnetic discharge apparatus employing an electrodless lamp containing mercury halide as a source of visible light. The electrodeless lamp includes no metallic elements within the envelope containing the plasma discharge. Thus, the halides which are known to be extremely chemically active are not in contact with any material with which they might react. Envelope materials composed of glass are generally compatible with the metal halide systems and the materials may be chosen from a variety of glasses such as fused silica or from a variety of ceramic materials such as alumimum oxide.

While there has been shown and described what are considered preferred embodiments of the present invention, it will be obvious to those skilled in the art that various changes and modifications may be made therein without departing from the invention as defined by the appended claims.

What is claimed is:

1. An electromagnetic discharge apparatus comprising an electrodeless lamp having an envelope of a substance transparent to visible light;

a fill material within said envelope consisting essentially of a material selected from the group consisting of mercuric iodide, mercuric bromide, mercuric chloride, and mixtures thereof; and an inert buffer gas; and means for coupling high frequency power to the fill material within the envelope to vaporize and excite the fill material producing visible light.

2. An electromagnetic discharge apparatus in accordance with claim 1 wherein said fill material includes an inert buffer gas at a pressure of 1 to 50 torr.

3. An electromagnetic discharge apparatus in accordance with claim 1 wherein said means for coupling high frequency power to the fill material includes an inner conductor and an outer conductor disposed around the inner conductor, the conductors having means at one end adapted for coupling to a high frequency power source and means at the other end for coupling high frequency power to the electrodeless lamp.

4. An electromagnetic discharge apparatus in accordance with claim 3 further including a source of high frequency power at a frequency between 1 MHz and 10 GHz coupled to said means at the one end of the conductors.

5. An electromagnetic discharge apparatus comprising an electrodeless lamp having an envelope of a substance transparent to visible light enclosing a fill material; and means for coupling high frequency power to the fill material within the envelope;

the fill material consisting essentially of an inert buffer gas and a source of mercury (I) halide molecules which are excited to a high energy state when high frequency power is applied and which emit visible light by photon emission transition to a lower energy state.

6. An electromagnetic discharge apparatus in accordance with claim 5 wherein said fill material consists essentially of a material selected from the group consisting of mercuric iodide, mercuric bromide, mercuric chloride, and mixtures thereof; and an inert buffer gas.

7. An electromagnetic discharge apparatus in accordance with claim 6 wherein said means for coupling high frequency power to the fill material includes an inner conductor and an outer conductor disposed around the inner conductor, the conductors having means at one end adapted for coupling to a high frequency power source and means at the other end for coupling high frequency power to the electrodeless lamp.

8. An electromagnetic discharge apparatus in accordance with claim 7 further including a source of high frequency power at a frequency between 1 MHz and 10 GHz coupled to said means at the one end of the conductors.

9. An electromagnetic discharge apparatus comprising an electrodeless lamp having an inner envelope of a substance transparent to visible light and to ultraviolet radiation enclosing a fill material consisting essentially of mercuric chloride and an inert buffer gas;

an outer envelope of a substance transparent to visible light surrounding said inner envelope and spaced therefrom;

a coupling fixture having an inner conductor and an outer conductor encircling the inner conductor;

the conductors having means at one end adapted for coupling to a high frequency power source and means at the other end coupled to said electrodeless lamp so that said electrodeless lamp forms a termination load for the coupling fixture and emits visible light and ultraviolet radiation when high frequency power is applied to said coupling fixture; and fluorescing material which emits visible light upon absorption of ultraviolet radiation disposed between the outer surface of said inner envelope and the inner surface of said outer envelope.

10. An electromagnetic discharge apparatus in accordance with claim 9 wherein said fluorescing material preferentially emits visible light in the red portion of the visible spectrum.

11. An electromagnetic discharge apparatus in accordance with claim 9 wherein said fluorescing material comprises a solid phosphor material adherent to the outer surface of said inner envelope.

12. An electromagnetic discharge apparatus in accordance with claim 9 wherein said fluorescing material comprises a solid phosphor material adherent to the inner surface of said outer envelope.

13. An electromagnetic discharge apparatus in accordance with claim 9 further including a source of high frequency power at a frequency between 1 MHz and 10 GHz coupled to said means at the one end of the conductors.

* * * * *